US005922984A

United States Patent [19]

Paterlini

[11] Patent Number: 5,922,984

[45] Date of Patent: Jul. 13, 1999

[54] ELECTRICAL SIMULATOR OF A PLECTRUM INSTRUMENT

[75] Inventor: Carlo Alberto Paterlini, Mantova, Italy

[73] Assignee: Charlie Lab S.r.l., Mantova, Italy

[21] Appl. No.: 08/800,735

[22] Filed: Feb. 13, 1997

[51] Int. Cl.[6] ..... G10H 1/38; G10H 3/18

[52] U.S. Cl. ..... 84/669; 84/724; 84/726; 84/731; 84/733

[58] Field of Search ..... 84/609–614, 634–638, 84/645, 646, 649–652, 666–669, 722, DIG. 22, DIG. 30, 258, 723–746

[56] References Cited

U.S. PATENT DOCUMENTS

| | | | |
|---|---|---|---|
| 4,630,520 | 12/1986 | Bonanno | 84/DIG. 30 |
| 4,658,690 | 4/1987 | Aitken et al. | 84/DIG. 30 |
| 5,033,353 | 7/1991 | Fala et al. | 84/DIG. 30 |
| 5,085,119 | 2/1992 | Cole | 84/DIG. 30 |
| 5,576,507 | 11/1996 | LaMarra | 84/645 |
| 5,602,356 | 2/1997 | Mohrbacher | 84/609 |

*Primary Examiner*—Stanley J. Witkowski
*Attorney, Agent, or Firm*—Guido Modiano; Albert Josif

[57] ABSTRACT

An electrical simulator of a plectrum instrument, including:

a microprocessor (3) which is suitable to convert a chord set up on a keyboard (13), received by means of a standardized signal, into a chord which is identical but is, in terms of fingering and number of strings, of the type obtained on the instrument to be imitated;

elements (7,19), equal in number to the strings of the instrument to be imitated, which are suitable to sequentially undergo a change in state caused by the hand of a user (12) who performs a movement that is identical to the one made to obtain the sound of the instrument to be imitated, and are suitable to send, as a consequence of said change, a signal to said microprocessor (3) to transmit said chord to a sound card by means of a standardized signal.

10 Claims, 2 Drawing Sheets

ELECTRICAL SIMULATOR OF A PLECTRUM INSTRUMENT

BACKGROUND OF THE INVENTION

The present invention relates to an electrical simulator of a plectrum instrument.

It is known that in the field of musical instruments there are instruments which include a keyboard connected to electronic equipment by means of which it is possible to imitate the sounds of many instruments: thus, by playing a certain chord on the keyboard, that chord will be heard as if it were played by a flute, a saxophone, or any instrument, according to the selection made by the user by pressing different buttons.

Commercially available instruments are all standardized, most of them according to a system known as MIDI: a chord played on the keyboard corresponds to the external output of a standardized signal and to a simultaneous signal to a sound card which is suitable to emit the sound and is contained within the instrument; external signals may also reach the sound card, and it is furthermore possible to interrupt communication between the keyboard and the sound card.

Instruments known as "sequencers" are also commercially available: these instruments emit standardized signals which are suitable for being received by a sound card to create an entire piece of music, and each emitted signal corresponds to a recorded chord originally set up on a keyboard.

The above described instruments allow to imitate excellently the sound of a vast number of different instruments but not of plectrum instruments such as the guitar or the mandolin, because in these instruments a chord is produced by a fingering, i.e. an action of the fingers, which is very different from the action used at the keyboard (it is enough merely to consider, for example, that the same chord is formed by pressing three keys on the keyboard and six strings on a guitar neck), and because the strings of plectrum instruments form the chord by acting at a very short time interval from each other due to contact with the user's descending and ascending hand.

SUMMARY OF THE INVENTION

The aim of the present invention is to provide a device which, when coupled to a keyboard instrument or sequencer of a known standardized type, allows to perfectly imitate the sound of plectrum instruments.

The proposed aim is achieved by an electrical simulator of a plectrum instrument, which includes a support and a series of string elements supported by the support such that each of the string elements may be engaged by a user so as to produce an engaged state of each string element which corresponds to a displacement of the engaged string element with respect to a non-engaged support position of the string element.

The simulator further includes a detecting device for detecting the engaged state of said each of the string elements and for producing electric signals indicating engaged states of engaged string elements, and a microprocessor electrically connected to the detecting device for receiving and processing the electric signals produced by the detecting device.

An input cable element is connected to the microprocessor for receiving standardized electrical signals corresponding to musical chords, and an output cable element is connected to the microprocessor for sending output electrical signals from the microprocessor to a sound card adapted for producing musical sounds of a series of musical instruments.

The microprocessor processes the standardized electrical signals and the electrical signals produced by the detecting device in order to produce the output electrical signals as the standardized electrical signals in response to the electrical signals produced by the detecting device.

BRIEF DESCRIPTION OF THE DRAWINGS

Further characteristics and advantages will become apparent from the description of two preferred but not exclusive embodiments of the invention, illustrated only by way of non-limitative examples in the accompanying drawings, wherein.

DESCRIPTION OF THE PREFERRED EMBODIMENTS

Figure 3:
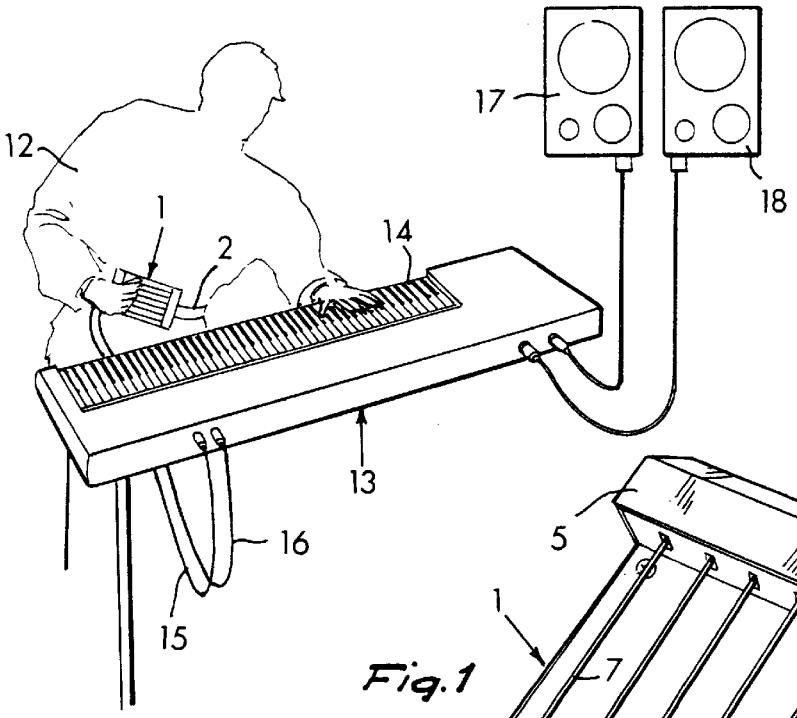
FIG. 3 is a view of one method for using the device according to the invention.
Figure 1:
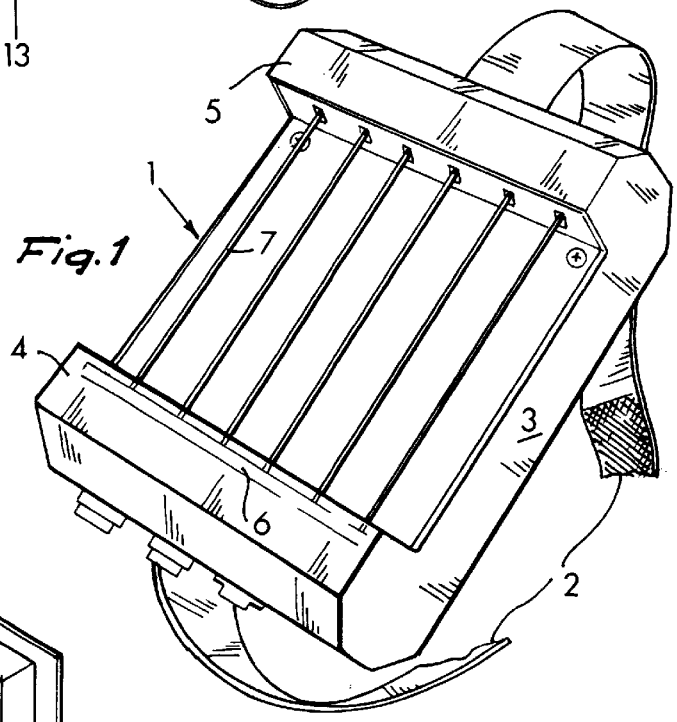
FIG. 1 is a perspective view of the invention.
Figure 2:
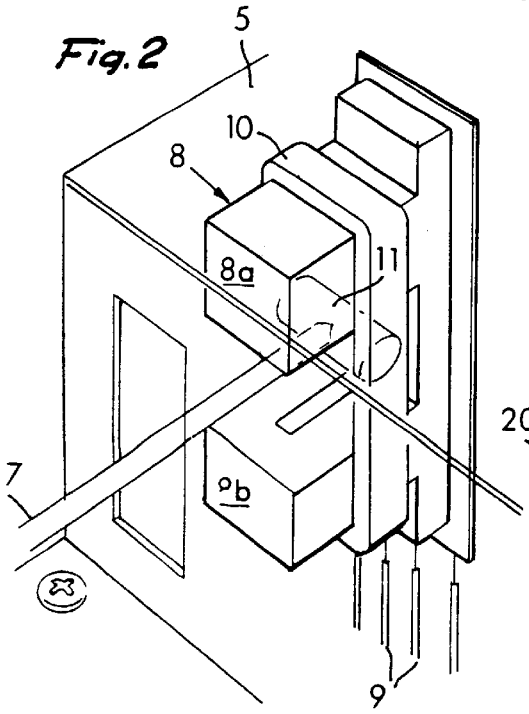
FIG. 2 is a view of a detail of FIG. 1 shown in phantom lines.

With reference to the above FIGS. 1, 2, 3 and 5, the reference numeral 1 designates the device meant to imitate the sound of a guitar, which is wholly contained in a small structure suitable to be fixed to the body of a user by means of straps 2, as clearly shown in FIG. 3.

The base 3 contains a microprocessor 30 which converts the chords set up on a keyboard 14 into chords exactly as they would be obtained by appropriately pressing one's fingers on the strings of a guitar; two bridges 4 and 5 extend from the base 3.

The bridge 4 contains the support 6, in which one end of metal bars 7 is snugly inserted; the bars are six, like the strings of the guitar that the device seeks to imitate, and are arranged parallel to each other, and lie within the same plane, exactly like the strings of a guitar.

At their other end, the bars 7 are each placed within the field of an optical sensor 8, connected to the microprocessor by means of conductors 9, between the part 8*a* that transmits a beam and the part 8*b* that receives it, so as to interrupt the beam in the non-deformed position shown in the figures, and so as to allow the beam to pass as a consequence of the elastic deformation caused by the passage of the user's hand, optionally provided with a plectrum.

Each bar 7 furthermore has a device that provides elastic return to the non-deformed position; the device comprises a rubber ring 10 which is in contact with the end of a hammer 11, which is rigidly coupled to the bar 7 and is made of nylon to facilitate its sliding.

In addition to the microprocessor 30, display means 31 and mode selection means 32 are provided.

The mode selection means 32 enable the user to select various operating functions displayed on the display means 31.

Power supply means and MIDI interface means (not shown in the figures) are connected to the device according to the present invention, in order to connect said device to a any MIDI device.

A form of use of the invention is now described with reference to FIG. 3.

A user 12 is able to play the per se known standardized electronic instrument 13 which comprises the keyboard 14 and includes an electronic device that is capable of sending simultaneously, at each chord played on the keyboard 14, a signal in output and a signal to a sound card which is contained in the instrument itself; it is possible to disconnect the communication between the keyboard and the sound card, and in this way the signal that corresponds to a chord played on the keyboard 14 is only sent externally with respect to the instrument; provisions are also made for the sound card to receive signals from outside.

In order to obtain the guitar sound from the sound card of the instrument 13, the user 12 fixes the device 1 to his belt after connecting said device, by means of the cable 15, to the output of the signals from the keyboard and, by means of the cable 16, to the input for signals from outside the sound card, and after disconnecting communication between the keyboard 14 and the instrument's sound card.

Music is played as shown in FIG. 3: the left hand of the user sets the desired chord on the keyboard 14, thus sending a signal (through serial data input 34) to the microprocessor 30 contained in the device 1, by means of the cable 15; said signal is processed in the sense that it is converted into a chord that is identical but is of the type that would be played by a user who acted on the strings of a guitar; the right hand, in contact with the bars 7, makes the same movement that it would make on the strings of a guitar, and the consequent status change of said bars makes the optical sensors 8 send signals to the microprocessor 30, consequently causing the microprocessor to send a standardized signal, through the cable 16, to the sound card contained in the instrument 13.

The optical sensors 8 are continously polled. If a bar 7 is moved by the user, the microprocessor 30 measures the moving speed and thus determines the value of the force imposed by the user on a certain bar 7.

The data related to the force value and to the note associated to said bar 7 enable the microprocessor 30 to send a suitably coded information through a serial output 35. Such information will be decoded by the connected device (any MIDI apparatus) e will be transformed in an audible sound.

The described methods for generating the chord emitted by the sound card, which is amplified by the speakers 17 and 18, clearly show that said chord is a perfect imitation of the chord played on a guitar.

The described form of use of the invention relates to an operator capable of playing the keyboard 14, but the device 1 could be equally connected to the output of an apparatus known as "sequencer" which emits, in the form of standardized signals, recorded chords initially set up on a keyboard in order to process them in the described manner and send them to a sound card which could be inserted in the sequencer itself or in a keyboard which an operator could just pretend to play.

Figure 4:
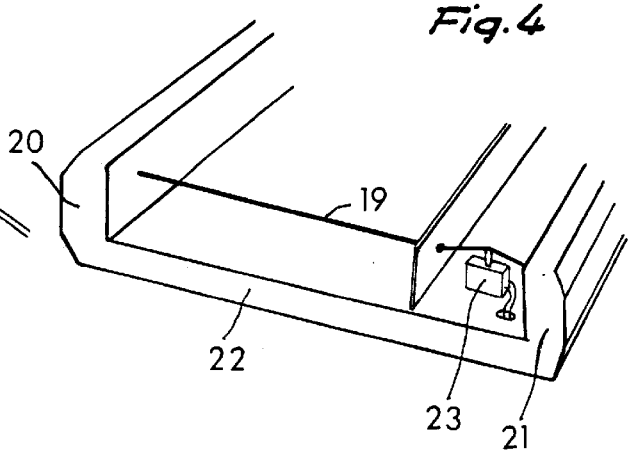
FIG. 4 is a view of a further embodiment of the invention.
Figure 5:
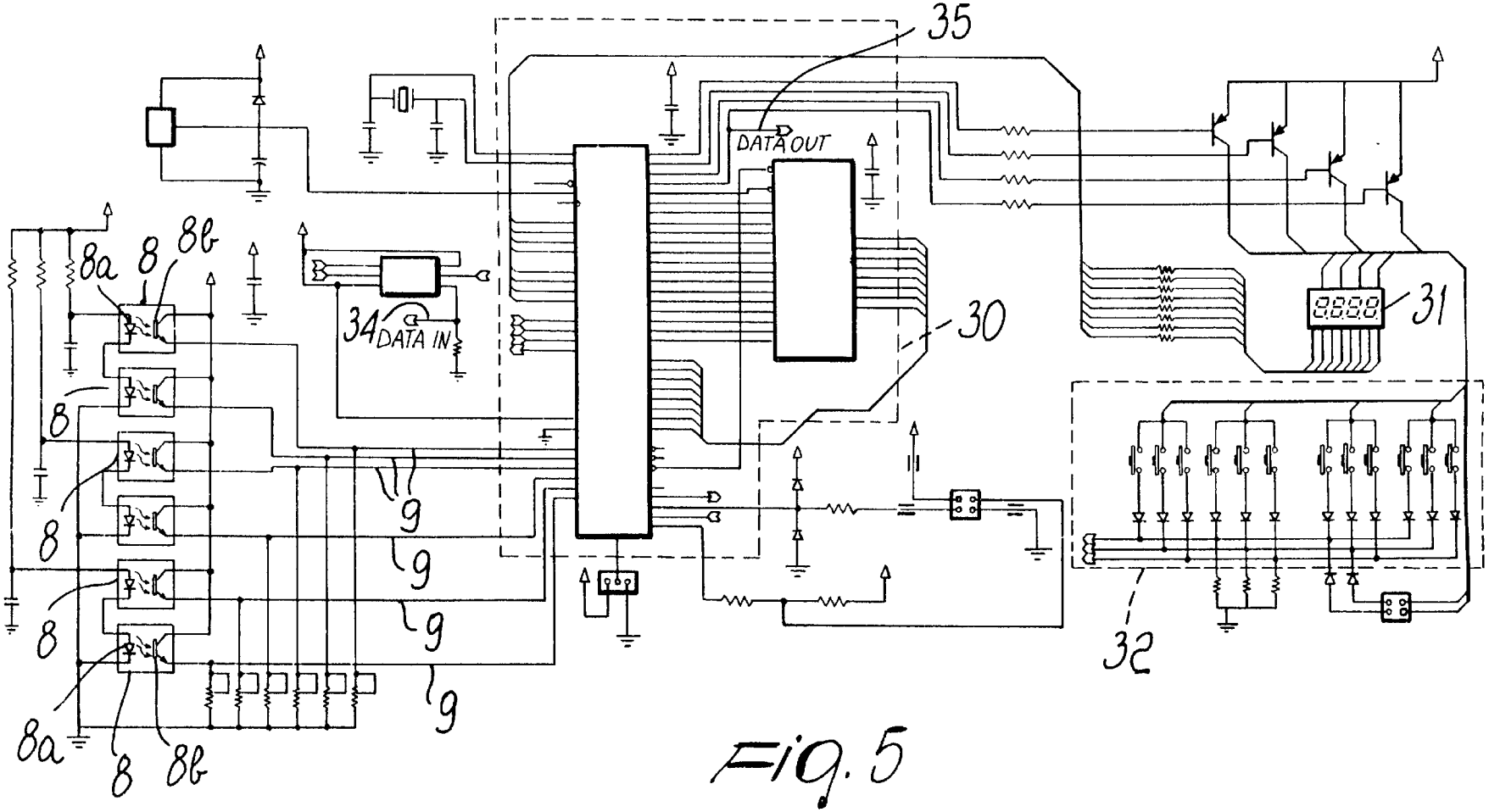
FIG. 5 shows the circuit layout of the electronics of the device according to the presente invention.

A further embodiment of the invention is shown in FIG. 4: in this embodiment, instead of the bars 7 there are wires 19, equal in number to the strings of the instrument to be imitated, which are stretched between the bridges 20 and 21 at the ends of the base 22 which contains the microprocessor 30; each wire is in contact with a microswitch 23 which is connected to the microprocessor so as to send it a signal when the wire changes its tension when touched by the user. A piezoelectric sensor connected to the microprocessor may also be in contact with a stretched wire 19. However, the elements suitable to undergo change, with a consequent transmission of a signal to the microprocessor as a consequence of their actuation by the user's hand, may assume even other embodiments.

According to one of these embodiments, each element can comprise a bar made of a material that is sensitive to a magnetic field, said bar being inserted between magnetic field generators which are connected to the microprocessor to send signals which are proportional to the change in said field caused by the movement of the bar produced by the user's hand.

In another embodiment, each element is shaped like a bar which is suitable to form an electrostatic field together with an adjacent bar, and said bar is connected to the microprocessor to transmit the changes in said field to said microprocessor when the bar is moved by the user's hand.

Each element may also be obtained by means of a strip of a printed circuit which is connected to the microprocessor and is suitable to undergo a change in state due to contact with a pen made of conductive material, or by means of a beam which runs from an emitting source to a receiver, both of which are connected to the microprocessor, said beam being suitable to be affected by the user's hand.

The described invention is susceptible of several other modifications and variations, all of which are within the scope of the inventive concept; for example, it is obvious that the number of elements like the bars 7 or the wires 19 will vary according to the instrument to be imitated and must always be equal to the number of strings of said instrument.

In the practical embodiment of the invention, all the details can be replaced with other technically equivalent elements; furthermore, any material, as well as any shape and dimension, may be employed.

What is claimed is:

1. An electrical simulator of a plectrum instrument comprising:

a support;

a series of string elements supported by said support such that each of said string elements may be engaged by a user so as to produce an engaged state of said each of said string elements which corresponds to a displacement of said each of said string elements with respect to a non-engaged support position of said each of said string elements;

a detecting device for detecting said engaged state of said each of said string elements and for producing electric signals indicating engaged states of said each of said string elements, said electric signals being also related to the force of engagement of said string elements by said user, independently from the order and mode in which said string elements are engaged by the user;

a microprocessor electrically connected to said detecting device for receiving and processing said electric signals produced by said detecting device;

an input cable element connected to said microprocessor for receiving standardized electrical signals corresponding to musical chords; and an output cable element connected to said microprocessor for sending output electrical signals from said microprocessor to a sound card adapted for producing musical sounds of a series of musical instruments;

said microprocessor being adapted for processing said standardized electrical signals and said electrical signals produced by said detecting device in order to produce said output electrical signals as said standardized electrical signals in response to said electrical signals produced by said detecting device.

2. The simulator of claim 1 wherein said input cable element connected to said microprocessor is adapted for receiving said standardized electrical signals produced by means of a keyboard of a standardized electronic instrument.

3. The simulator of claim 1 wherein said detecting device comprises an optical sensor for each of said string elements.

4. The simulator of claim 1 wherein said detecting device comprises a microswitch for each of said string elements.

5. The simulator of claim 1 wherein said detecting device comprises a piezoelectric sensor for each of said string elements.

6. The simulator of claim 1 wherein said detecting device comprises magnetic field generators disposed about said string elements which are formed with material that is sensitive to a magnetic field.

7. The simulator of claim 1 wherein said detecting device comprises means for producing and electrostatic field.

8. The simulator of claim 1 wherein said detecting device comprises an electrically conducting pen operatable by a user, said string elements being formed of printed circuit strips.

9. The simulator of claim 1 wherein said detecting device comprises beam emitting means and beam receiving means and wherein said string elements comprise beams formed by said beam emitting means.

10. The simulator of claim 1 wherein said microprocessor is carried by said support.

* * * * *